United States Patent [19]

Kinninger

[11] 4,197,808

[45] Apr. 15, 1980

[54] COMBINED ROAD MARKER AND INTERCHANGEABLE SIGN CARDS

[76] Inventor: James L. Kinninger, 991 - 6th St., Hermosa Beach, Calif. 90254

[21] Appl. No.: 37,198

[22] Filed: May 8, 1979

[51] Int. Cl.[2] ..... E01F 9/10; G09F 7/02

[52] U.S. Cl. ..... 116/63 C; 40/607; 40/612

[58] Field of Search ..... 116/63 C, 63 P; 404/13; 40/612, 310, 606, 607, 21 B

[56] References Cited

U.S. PATENT DOCUMENTS

| | | | |
|---|---|---|---|
| D. 139,032 | 6/1944 | Wandell | 116/63 P |
| 2,819,547 | 1/1958 | Clements, Jr. | 40/612 |
| 3,408,758 | 11/1968 | Doring | 40/310 X |
| 3,732,842 | 5/1973 | Vara, Sr. | 40/612 X |
| 3,785,331 | 1/1974 | Ferris | 40/607 X |

*Primary Examiner*—Daniel M. Yasich

*Attorney, Agent, or Firm*—Whann & McManigal

[57] ABSTRACT

A traffic controlling and road hazard warning device comprising a resilient frustro-conical or cylindrical road marker and a plurality of informational sign cards that are interchangeably and separably mounted on the upper end of the marker by means of slots and so designed to engage the upper end of the marker thereby securing the cards and preventing their rotation, yet allowing rapid installation and positioning of the cards on the marker.

5 Claims, 2 Drawing Figures

18
15
21
17
2
2
13
5a
16
19
16
20
12
10

22
13
21
15
20
2
2
16
16
12
10

COMBINED ROAD MARKER AND INTERCHANGEABLE SIGN CARDS

RELATED APPLICATION

This application is related to U.S. Application, Ser. No. 846,776, filed Oct. 25, 1977.

BACKGROUND OF THE INVENTION

It has been generally known heretofore to control or divert the flow of vehicular traffic around temporary road hazards or other unusual conditions by the use of portable traffic markers, (U.S. Pat. No. 2,719,505, H. Blumenthal).

The markers often of a frustro-conical or cylindrical shape are constructed of brightly colored, lightweight, resilient material that withstand inadvertent impact by motor vehicles.

Markers of this type have become widely accepted as an effective means of diverting the flow of traffic as they possess high visibility, are easily portable and can be set up conveniently, often from a slowly-moving vehicle so as to rapidly position a string of markers to divert vehicular traffic around a road hazard or other obstacle.

Such strings of markers while effective at diverting vehicular traffic do not provide any information as to the nature of the impending hazard, the speed limitation or other traffic control information. Thus, such markers must be used in conjunction with separate informational traffic signs to effectively and safely control the flow of vehicular traffic around hazards or obstacles.

Present practice requires that such signs be mounted on individual stands, propped against the road markers or stuck in an expansion joint or crack in the roadway.

Erection and placing of informational traffic control signs in the foregoing configurations is time-consuming and difficult if not impossible to accomplish from a moving vehicle. Furthermore, signs that are propped against markers or stuck into cracks in the roadway are subject to being blown over or disturbed from their set positions by the draft created by passing vehicles and are less visible as they are low to the ground.

Accordingly, the present invention by using a resilient road marker as a base or standard for readily interchangeable informational traffic signs provides an improved traffic control device which possesses information as to traffic control, high visibility, stability and can be rapidly assembled and erected from a slowly moving vehicle in any convenient location.

SUMMARY OF THE INVENTION

The present invention relates to traffic control devices and more particularly to a hollow frustro-conical or cylindrical type of safety marker with a plurality of interchangeable informational sign cards mounted thereon so as to act not only as a vehicular barrier in controlling and diverting motor traffic, but also as a highly visible and improved means of relaying information as to road hazards and conditions to the approaching motorist.

The present invention utilizes a hollow frustro-conical or cylindrical road marker made of plastic or other resilient material as a supporting base or standard for a plurality of interchangeable informational sign cards.

The sign cards are readily mounted on the upper open end of the marker cone or cylinder by means of downward diverging slots in the cards so designed to engage the walls of the marker, distorting the marker's normally circular aperture to an elliptical configuration thereby causing the sign card to be firmly secured in its set position.

The combined structure provides a traffic control device of high stability and visibility, that may be rapidly assembled and conveniently set into position from a slowly moving vehicle, eliminating the need for traffic sign structures separate and apart from the road marker.

The primary object of the invention is to provide an improved traffic control device having a plurality of interchangeable informational sign cards with appropriate legends thereon to warn motorists of traffic diversion or control, which are mounted on a base or support consisting of a resilient road marker.

Another object is to provide an improved traffic control device of high stability and visibility.

Still another object is to provide an improved traffic control device comprising interchangeable informational sign cards mounted on a resilient road marker that may be placed in position from a moving vehicle.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings which are for illustrative purposes only.

DESCRIPTION OF THE PREFERRED EMBODIMENT

An upwardly extending hollow frustro-conical structure 12 of resilient plastic or other suitable material terminates in a reduced upper end 13 possessing a substantially circular cross section.

The adjacent portion of said upper end 13 is capable of being deformed from its normally circular shape to an elliptical configuration.

Figure 2:
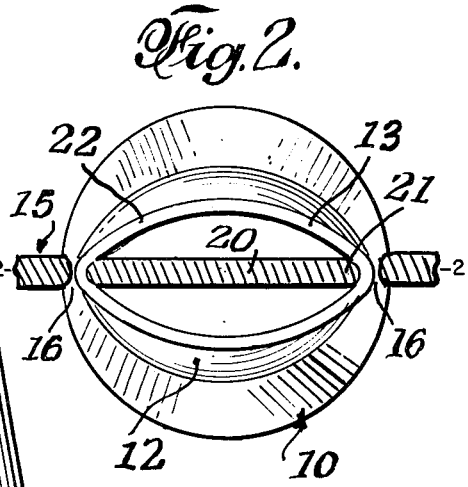
FIG. 2 is a sectional view of the combined road marker and sign card shown in FIG. 1 taken along 2—2.

This is shown in FIG. 2 in which the circular aperture of the marker's upper end 13 is flexed from its normally substantially circular shape to an elliptical configuration 22 by mounting on the marker's upper end 13 an informational sign card 15, containing two downward diverging slots 16 that extend partially across the card from one edge thereof and are designed so as to engage the mentioned reduced upper end 13 of the marker structure 12.

It will be understood that in an alternate embodiment of the invention, the above-described marker or standard 12 supporting the sign cards 15 may possess a cylindrical or other shape and that the upper end of the standard or marker may terminate in an inwardly directed flange creating an aperture substantially circular in shape.

Figure 1:
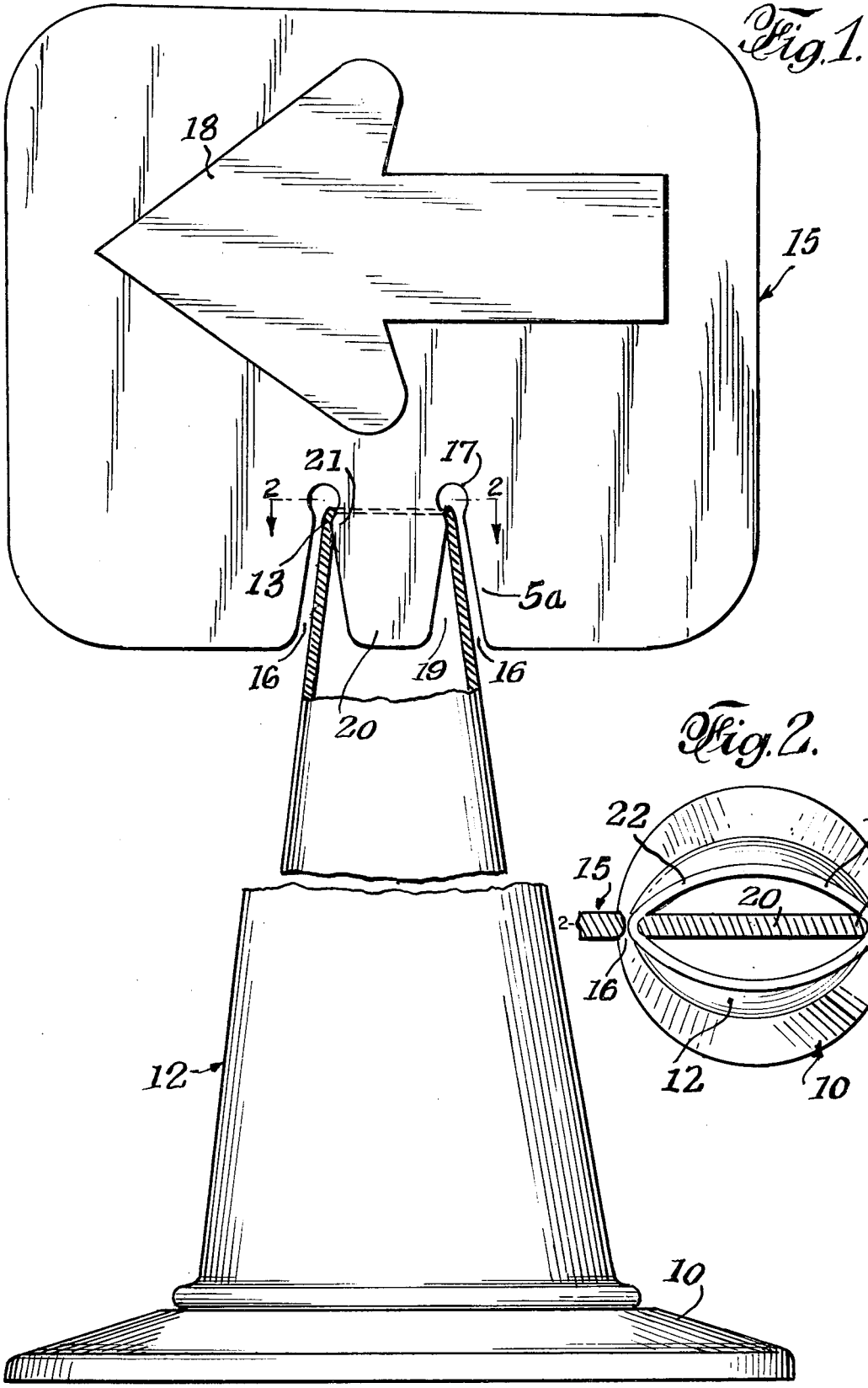
FIG. 1 is a vertical elevational view of a hollow, frustro-conical road marker with an informational sign card mounted on its upper end.

As shown in FIG. 1, each slot 16 of card 15 has an enlarged closed end 17 which serves to stop the interior engagement of the upper end 13 of the maker 12 and the walls of the card 15.

It will be clear that a compliment of such cards 15 may be provided with a symbol 18 or other appropriate legend on one or both of its sides and may be interchangeably mounted on the reduced end portion 13 of the marker.

As may be seen in FIG. 1, to provide for more rapid and ready mounting of the cards 15 on the marker 12, the open ends of the slots 16 are flared at 19 enabling the slots 16 to accommodate markers of varying diameters.

It will be understood that the aperture at the upper end 13 of the marker 12 is initially substantially circular and of a size to engage the edge section 20 that is formed intermediate the flared portions 19 of the slots 16 of card 15.

To provide for a stable clamping of the card 15 when mounted on the upper end of the marker 12, the mentioned edge section 20 is so proportioned in relation to the upper end 13 of the marker 12 as to cause the circular aperture of the upper end 13 to be widened into an ellipse 22, as shown in FIG. 2, when the edge section 20 increasingly engages the interior surface of the marker 12.

As the edge section 20 of card 15 is further inserted into the aperture at the marker's end 13, the enlarged slot ends 17 are encountered and permit the upper end 13 of the marker 12 to contract slightly, deflecting inward as shown in FIG. 1, thereby further securing the card 15 in its set position.

It will be clear that upon said marker's wall section being fully engaged in the slots 16, the outer portion 5a of the slots 16 will be frictionally engaged with the outer surface of cone 12 and also aid in preventing rotation of the sign from its set position.

Various modifications may suggest themselves to those skilled in the art without departing from the spirit of the invention and hence I do not wish to be restricted to the specific forms shown or uses mentioned, except to the extent indicated.

I claim:

1. A base mounted, hollow bodied, frustro-conical road marker formed of a resilient material, having a circular aperture at its upper end;

a plurality of interchangeable informational sign cards, removably receptive of said road marker, having downwardly diverging slots extending partially across a selected one of said cards from one edge thereof;

an edge section intermediate said slots having a reduced lower end and a widened upper end such that when said edge section is inserted into said aperture, said aperture is distorted from its normally circular form to an elliptical configuration so as to cause the upper end of said marker to frictionally engage said edge section of said card so as to secure the card in position and prevent rotation from its set position.

2. The combined road marker and sign cards as defined in claim 1 in which the upper end of said marker terminates in a circular inturned flange.

3. The combined road marker sign cards as defined in claim 1 in which said slots in said cards terminate in enlarged closed ends.

4. The combined road marker and sign cards as defined in claim 1 in which said marker is cylindrical.

5. A base mounted, frustro-conical, hollow bodied road marker formed of a resilient material, having a circular aperture at its upper end;

a plurality of interchangeable, informational sign cards removably receptive of said marker, having two downwardly diverging slots extending partially across a selected one of said cards from one edge thereof;

said slot's interior terminus having an enlarged, substantially circular shape;

an edge section intermediate said slots having a reduced lower end and a widened upper end, such that when said edge section is inserted into said aperture, said aperture is distorted from its normally circular form to an elliptical configuration so as to cause the upper end of said marker to frictionally engage said edge section of said card so as to secure the card in position and prevent its rotation from its fixed position.

* * * * *

UNITED STATES PATENT OFFICE

CERTIFICATE OF CORRECTION

Patent No. 4,197,808 Dated April 15, 1980

Inventor(s) JAMES L. KINNINGER

It is certified that error appears in the above-identified patent and that said Letters Patent are hereby corrected as shown below:

Column 1, line 4, delete "This application is related U. S. Application Ser. No. 846,776, filed October 25, 1977." and insert -- This application is a Continuation-in-Part of U. S. Application Serial No. 846,776, filed October 25, 1977. --

Signed and Sealed this

Nineteenth Day of October 1982

[SEAL]

Attest:

GERALD J. MOSSINGHOFF

Attesting Officer

Commissioner of Patents and Trademarks